US010577808B2

(12) United States Patent
Svensson-Hilford et al.

(10) Patent No.: US 10,577,808 B2
(45) Date of Patent: Mar. 3, 2020

(54) METHOD FOR MODERNIZING A BUILDING AND STRUCTURE WITH AN ELEVATOR SYSTEM CONSTRUCTED IN A BUILDING

(71) Applicant: Inventio AG, Hergiswil (CH)

(72) Inventors: Lennart Svensson-Hilford, Teltow (DE); Sönke Mestemacher, Coppenbrügge (DE)

(73) Assignee: INVENTIO AG, Hergiswil NW (CH)

( * ) Notice: Subject to any disclaimer, the term of this patent is extended or adjusted under 35 U.S.C. 154(b) by 0 days.

(21) Appl. No.: 16/310,095

(22) PCT Filed: Jun. 21, 2017

(86) PCT No.: PCT/EP2017/065241
§ 371 (c)(1),
(2) Date: Dec. 14, 2018

(87) PCT Pub. No.: WO2017/220653
PCT Pub. Date: Dec. 28, 2017

(65) Prior Publication Data

US 2019/0323245 A1 Oct. 24, 2019

(30) Foreign Application Priority Data

Jun. 21, 2016 (EP) ..... 16175551

(51) Int. Cl.

| | |
|---|---|
| ***E04F 17/00*** | (2006.01) |
| ***E04F 11/02*** | (2006.01) |
| ***E04G 23/02*** | (2006.01) |
| ***B66B 19/00*** | (2006.01) |

(52) U.S. Cl.
CPC ..... *E04F 17/005* (2013.01); *B66B 19/00* (2013.01); *E04F 11/02* (2013.01); *E04G 23/0266* (2013.01)

(58) Field of Classification Search
CPC .... E04F 11/02; E04F 17/005; B66B 11/0005; E04G 23/0266; E04B 1/34
See application file for complete search history.

(56) References Cited

U.S. PATENT DOCUMENTS

2014/0123577 A1* 5/2014 Yarmolinsky ..... E04F 11/02 52/167.1

FOREIGN PATENT DOCUMENTS

| | | | | |
|---|---|---|---|---|
| DE | 102011052727 A1 | 3/2013 | | |
| DE | 102011115217 A1 | 3/2013 | | |
| DE | 202014101953 U1 * | 9/2014 | ..... | E04F 11/02 |
| DE | 102014114904 A1 | 10/2015 | | |
| JP | 2002012379 A | 1/2002 | | |

(Continued)

*Primary Examiner* — Christine T Cajilig
(74) *Attorney, Agent, or Firm* — William J. Clemens; Shumaker, Loop & Kendrick, LLP

(57) ABSTRACT

In a method for modernizing a building, a former stairwell of the building is converted such that an elevator shaft of an elevator system to be constructed can be provided in the former stairwell. The elevator shaft is provided in the former stairwell of the building such that stepless access is facilitated to specific floors of the building from an elevator car of the elevator system, which car can be provided in the elevator shaft. A new staircase is constructed outside the former stairwell. In addition, a former staircase is removed from the former stairwell. Furthermore, access bridges are disposed next to the elevator shaft in the former stairwell, thereby enabling flush access from the new staircase to the specific floors.

15 Claims, 8 Drawing Sheets

(56) References Cited

FOREIGN PATENT DOCUMENTS

| | | | | |
|---|---|---|---|---|
| JP | 2003013615 | A | 1/2003 | |
| JP | 4242040 | B2 * | 3/2009 | ..... E04G 23/0266 |

* cited by examiner

METHOD FOR MODERNIZING A BUILDING AND STRUCTURE WITH AN ELEVATOR SYSTEM CONSTRUCTED IN A BUILDING

FIELD

The invention relates to a method for modernizing a building, conversion taking place in the region of a stairwell of the building, which conversion relates to regions outside the stairwell, in particular outside the building, and enables installation of an elevator system into the stairwell. The invention further relates to a structure with an elevator system constructed in a building.

BACKGROUND

A preferred starting point is an existing building, such as an apartment building, an office building, an administration building or the like, in which access to specific floors is possible only via a stairwell. This also includes situations in which, for example, a modern or already modernized part of a building already comprises at least one elevator system, and an older or non-modernized part of the building is to be equipped with an elevator system. When the building having at least one or at least one additional elevator system is upgraded, accessibility via a staircase in close proximity to the constructed elevator should still be ensured at the same time. In this case, the individual floors of the building should be developed such that they can be reached in a flush and preferably barrier-free manner via the elevator system to be constructed.

One particular application relates to a building of this kind, in which the individual floors can so far be reached only via the existing staircase. This is because conversion, in particular when the staircase is demolished in part, can lead to restrictions to the accessibility of the building, which considerably restricts the scope of application if the usability of the building cannot be ensured during conversion.

DE 10 2011 115 217 A1 discloses a method for converting a double-run stairwell without an elevator shaft into a staircase having a single-run staircase, bridge and elevator shaft in front thereof. In this method, an extension is constructed outside the previous building, which extension comprises an elevator shaft and an expansion of the previous stairwell, which expansion is open towards the previous stairwell. Due to this expansion, landings can be implemented, via which an elevator arranged in the elevator shaft can be accessed. Furthermore, a flight of stairs can be extended into the expansion. As a result, the other flight of stairs in each case can be removed and bridges for the individual levels can be inserted at the points thereof.

The method known from DE 10 2011 115 217 A1 has the disadvantage that implementation may not be possible in each specific case, which therefore restricts the scope of application. A problem in this regard is in particular the large enclosed construction volume of the extension, which is required for expanding the stairwell and for the elevator shaft outside the previous building. This can be problematic with regard to the practically available space and for aesthetic reasons. However, legal regulations should also be observed, which preclude a solution of this kind in principle or at least in practice. For example, regulations with regard to distance spaces to be observed can have the result that the construction project cannot be approved for legal reasons. Alternatively, this can be achieved only with an elevator shaft that is smaller than desired. In addition, facilitations or exemptions with regard to building regulations may not be possible. For example, an exemption of this kind, which relates to facilitations with regard to the required distance spaces, for example, may relate only to retrospectively constructed stairwells, but not to extensive constructions that include an elevator shaft. There is another disadvantage with regard to connecting or directly spatially expanding the stairwell in the additional extension. This may make it necessary to completely integrate the extension into the outer insulation of the building.

DE 10 2014 114 904 A1 discloses arranging an elevator in the stairwell of an existing building. The starting point of the conversion for this known structure is a building that includes a stairwell extending from a basement over several floors and having intermediate landings arranged halfway up each floor. Before conversion, there is the problem that one flight of stairs has to be climbed from each intermediate landing in order to reach a floor. An elevator arranged outside the building, which elevator stops at the intermediate landings, can therefore not allow barrier-free access to the individual floors. It is therefore proposed to attach an extension that expands the stairwell beyond the previous outer wall, the previous intermediate landings, which are arranged inside the original stairwell, becoming components of the new staircase. The removal of a flight of stairs made possible thereby therefore creates space for an elevator arranged inside the previous stairwell.

The structure known from DE 10 2014 114 904 A1 has the disadvantage that opening the previous stairwell to the outside during conversion may make it necessary to completely integrate the extension into the outer insulation. Furthermore, the horizontal cross section provided for constructing the elevator shaft is restricted by the remaining intermediate landings and the available flights of stairs. Therefore, despite extensive conversion measures, only a small elevator can be implemented if necessary.

SUMMARY

A problem addressed by the invention is to specify an improved method for modernizing a building and an improved structure with an elevator system constructed in a building. In particular, a specific problem can be considered that of implementing a comparatively large elevator system, in particular a comparatively large horizontal cross section of the elevator shaft, with regard to the necessary conversion work, thus leading to a greater scope of application, as requirements with regard to construction and building regulations can be met more easily. Furthermore, a specific problem can be considered to be that of enabling installation of the elevator system into the existing building and the conversion of the building required for this purpose such that the building remains at least largely usable and in particular accessible during conversion. Another specific problem can be considered that of restricting required conversion and expansion work to the building to relatively simple construction and demolition work, in particular changes to an outer wall or outer façade being minimized.

In the following, solutions for a corresponding method and for a corresponding structure with an elevator system constructed in a building are specified, which solutions solve at least one of the problems mentioned. Furthermore, advantageous developments and embodiments are specified.

A proposed solution consists in a method for modernizing a building, a former stairwell of the building being converted such that an elevator shaft of an elevator system to be constructed can be provided in the former stairwell, and the elevator shaft being provided in the former stairwell of the building such that stepless access is facilitated to specific floors of the building from an elevator car of the elevator system, which car can be provided in the elevator shaft, and a new staircase being constructed outside the former stairwell, the former staircase being removed from the former stairwell at least in a region of the former stairwell extending over the specific floors and access bridges being disposed next to the elevator shaft in the former stairwell, thereby enabling substantially flush access from the new staircase to the specific floors. The access bridges are substantially step-free. This means that the access bridges are designed as horizontal longitudinal supports, this substantially meaning that individual landings or thresholds can be present in transition regions and door regions if need be. The connection from the new staircase to each floor is therefore substantially flush. The access bridges are preferably substantially horizontal.

A further solution consists in a structure with an elevator system constructed in a building, an elevator shaft of the elevator system being arranged in a converted former stairwell of the building and the elevator shaft being arranged in the former stairwell of the building such that stepless access is facilitated to specific floors of the building from an elevator car of the elevator system, which car is provided in the elevator shaft, a new staircase being provided which is constructed outside the former stairwell, access bridges being provided which are disposed next to the elevator shaft in the former stairwell, and access, preferably flush access, from the new staircase to the specific floors via the access bridges being facilitated.

When the former staircase is removed from the former stairwell, it is essential that the functional purpose of the former staircase, i.e. the ability to reach the individual determined floors via said staircase, no longer exists after removal. The former staircase can be removed, depending on the design of the former staircase, by means of demolition, for example. However, it is conceivable in this case that parts of the former staircase remain intact, in order to serve as support bearings for the access bridges or as fastening points for the elevator system to be constructed, for example.

Advantageously, the new staircase is outside the former stairwell. It is therefore possible that the former stairwell and the new stairwell in which the new staircase is constructed are spatially separated. In particular, the thermal insulation can be maintained at this location in an optionally renewed form. This may lead to cost-optimized implementation of an extension in which the new stairwell is enclosed. In each application, this makes it possible to design an outer and/or emergency exit staircase.

It is therefore advantageous that the new staircase is constructed in a new stairwell which is separated from the former stairwell by a wall of the building, and that preferably passages are formed in the wall which can preferably be closed by doors and facilitate access from the new staircase to the specific floors or to the access bridges. The measure, which is to be regarded as an option, of closing passages in the wall by doors makes it possible to implement thermal insulation, as required on the outer side of the building, in particular with low effort. In this case, it is advantageous that the wall of the building is at the point of an outer wall or a former outer wall of the building. The doors may also be designed as fire doors, so that in the event of a fire, the new stairwell can be used as an evacuation staircase. There may therefore be no need for storage spaces, which might otherwise be required for placing evacuation ladders or the like.

If the access bridges or the specific floors can be accessed from the new staircase through closable passages in the wall, lower access to the new stairwell can be open. Alternatively, access from the new staircase to the access bridges can be open, of course, and only the lower access can be closed by a main door or, if access doors to the individual apartments of a floor are designed as external doors, any closable doors in the region of the new stairwell can be dispensed with.

In an advantageous embodiment, the new staircase can therefore be constructed in a new stairwell that is designed as an attached cold stairwell. This results in the advantage that the new stairwell additionally attached to a certain extent accommodates the new staircase completely, but also that the volume enclosed by the extension can be restricted at the same time to the minimum space required in each application. As a result, a special arrangement with regard to building regulations is possible for a retrospectively attached staircase space, which makes only reduced distance spaces necessary. In this case, reinforced concrete parts and/or prefabricated parts equipped with sheet glass and/or other prefabricated parts can be used, so that the staircase can be protected against the weather with little effort. The construction and dimensions of the new staircase can be adapted to desired properties in this case. For example, the requirement that a stretcher can be transported via the staircase in the event of a fire is taken into consideration. Furthermore, it may be necessary or desired that elements, in particular access bridges, can be brought to their position in the former stairwell via the new staircase for conversion. "Via the new staircase" does not mean that the access bridges have to be carried up through the stairwell. The stair construction of the new staircase may, for example, have support points that enable a lifting device for lifting the access bridges to be fastened, so that the access bridge can be lifted along the staircase façade of the new staircase and brought into the building at the height of the corresponding floor. The access bridges may also be lifted by means of a movable hoisting crane, of course.

The new stairwell, which is aligned with the floor locations of the specific floors, can be lifted advantageously at the beginning of the conversion process. In this case, the new stairwell can advantageously comprise both the stair structure for the staircase and a wall end to the building. In this case, the wall end may comprise thermal insulation, a supporting structure for the access bridges to be installed and the like.

Preferably, starting from the top, the flights of stairs and optionally parts of the old building outer wall can be removed floor by floor and an access bridge can be inserted on the relevant floor. The access bridge then leads in a flush, substantially horizontal manner from the new stairwell to the relevant floor.

It is advantageous that the access bridges are designed so as to have a minimum permissible access width at least along an access portion, passing the elevator shaft, between the staircase and a relevant floor landing. Specifically, the access bridges may have a minimum access dimension of from 0.9 m to 1.0 m, for example. The minimum access dimension is preferably specified such that the access bridge can be used as an escape route. Designing the access bridge to the minimum access dimension makes it possible to produce the largest possible open space for the future elevator system, in order to be able to install the largest possible elevator car. After an access bridge has been installed, the corresponding floor can be accessed again immediately. Depending on the necessary conversion measures, in particular the time required for demolishing a flight of stairs, it is possible that access to an individual affected floor is obstructed only for a few hours. The building is therefore substantially continuously accessible during the conversion work, with the exception of temporary restrictions that may relate to only one floor in each case depending on how conversion is carried out. In this case, when the relevant flight of stairs is being removed and when the corresponding access bridge is installed, a temporary protective roof can be assembled in order to protect lower staircases and/or to facilitate access via a lower staircase of this kind. Occasionally, lower flights of stairs can also be temporarily shut for reasons of safety.

It is also advantageous that the access bridges are designed so as to have an access width at least along an access portion, passing the elevator shaft, between the staircase and a relevant floor landing, which access width is smaller than a width of a former flight of stairs of the former staircase. Space that is provided for the elevator shaft can therefore be correspondingly larger. In particular, the elevator shaft can then extend horizontally over a cross section that projects beyond a horizontal cross section of an individual flight of stairs.

It is advantageous that the former staircase is removed from the former stairwell at least in the region of the former stairwell extending over the specific floors and the access bridges are arranged in the former stairwell. In particular, the new staircase can therefore be constructed at the beginning or at least after required openings have been made in the wall, in particular the outer wall. Access is therefore possible via the new staircase both to the individual floors, which are already connected via access bridges, and in order to carry out work. For example, the access bridges can be transported via the new staircase, if the new staircase has been constructed in a correspondingly suitable manner.

It is also advantageous that the access bridges are arranged successively in the former stairwell from the uppermost floor of the specific floors to the lowermost floor of the specific floors. This means that, for example, some of the specific floors can still be accessible from a ground floor, while other floors are gradually connected, from top to bottom, to the new staircase via the access bridges. Aside from temporary interruptions, which can last for a few hours, for example, and may each affect only one floor, all the floors of the building are still accessible even during conversion work. Conversion can therefore be ensured during operation or whilst the building is inhabited. It is therefore also advantageous in this case that an access bridge for one of the specific floors is arranged in the former stairwell in each case in a stepwise manner and the former staircase between this specific floor and the specific floor underneath is removed. In order to remove the staircase portion, a protective roof may be temporarily inserted. When the stair portion is removed, two flights of stairs and an intermediate platform arranged therebetween, which is located halfway up the floor, for example, can be removed, for example.

Alternatively, the access bridges can of course be arranged or integrated in the former stairwell successively in the reverse sequence from the lowermost floor of the specific floors to the uppermost floor of the specific floors, particularly if the building is not occupied during the conversion phase. Occasionally, all the former staircases can also be removed in a first step, such that the stairwell is empty and the access bridges can, together with the wall for the elevator shaft, be inserted and installed into the stairwell.

It is advantageous that a wall for the elevator shaft is constructed in the former stairwell and that the former staircase is removed from the former stairwell at least in the region of the former stairwell extending over the specific floors and the access bridges are arranged in the former stairwell before the wall for the elevator shaft is constructed in the former stairwell. Specifically, after the new staircase is constructed and all the planned access bridges are introduced, conversion can first take place such that all the floors are linked via the new staircase, if required. In this case, a ground floor may in particular be accessible via the entrance to the building. As a result, the major disturbances caused by the conversion work, which arise due to the dirt produced and the noise pollution during demolition, are restricted to a short period, in particular a few days. Subsequently, the work required for constructing the elevator system can be carried out at least substantially. This makes it easier to plan and coordinate the individual trades.

The wall for the elevator shaft that is constructed in the former stairwell can advantageously be composed of wall elements. In this case, the wall elements may be designed such that they can be inserted in each case between two access bridges arranged one on top of the other. In this case, the access bridges can be prepared accordingly in order to make it easier to install the wall elements. Specifically, it is advantageous in this case that the wall for the elevator shaft from the lowermost floor of the specific floors to the uppermost floor of the specific floors is composed of wall elements of this kind. The individual wall elements can therefore be gradually supported on one another during installation. Furthermore, a connection to each access bridge can be established. The wall bridges can in particular have an angular profile that is U-shaped in the horizontal cross section and can be open to a wall of the former stairwell. The wall elements are preferably also fastened to this wall. The wall elements can be made in part from transparent material, such as glass. This improves the light flooding into the floor space.

In one embodiment, the wall elements for the wall of the elevator shaft can also be assembled starting from the top. In this case, a free lower space in the stairwell, which is produced by the space next to the access bridges, can be used for transporting the wall elements. Selecting the suitable assembly sequence depends on the design of the wall elements, for example.

It is advantageous that components for the elevator shaft are already attached to the access bridges during arrangement in the former stairwell. Components of this kind may be, for example, parts of the future wall of the elevator shaft, door attachment parts or fastening structures for fastening guide rails. This makes it possible, for example, that essential preliminary work can already be carried out before the access bridges are delivered to the building site. This decreases the time required for installation into the building. In addition, the danger of falling tools and components and the danger of a technician or builder falling can be reduced, as parts are already fastened to the access bridges.

Furthermore, it is advantageous that a handrail is fastened to the access bridges after arrangement in the former stairwell at the latest and at least until a wall is constructed for the elevator shaft, which handrail prevents falling into the elevator shaft. This handrail can be removed completely or in part after the wall for the elevator shaft has been constructed. Depending on application, a handrail of this kind can optionally be pre-assembled on the access bridges completely or in part. In one embodiment, the handrail may also be a component of the wall for the elevator shaft. The handrail may be a fixed balustrade, for example, on which glass walls can be placed during subsequent completion of the wall.

The access bridges can therefore already have attachment parts of the future elevator or for the future wall or at least elements for a handrail.

It is also advantageous that the new staircase is constructed such that the access bridges can be brought to the specific floors via the new staircase at least in order to construct the elevator system. In this case, devices which make lifting the access bridges easier can be installed at least temporarily in the new stairwell. Furthermore, the new stairwell can be at least partially opened for this purpose, so that it is possible to lift the access bridges next to the new staircase, for example. In particular, a front of the new stairwell further away from the former stairwell can be closed only when the access bridges are inserted into the former stairwell.

In particular, it is advantageous in this case that the access bridges are designed as longitudinally adjustable access bridges. For example, the access bridges can be longitudinally adjustable in accordance with a telescopic design. This facilitates precise length adjustment at the installation location. Transport of the access bridges to the installation location is also made easier as a result.

It is also advantageous that a counterweight space, which is reserved for the travel of the counterweight in the elevator shaft, is implemented on a side of the elevator car nearer the new staircase or on a side of the elevator car further away from the new staircase. The horizontal cross section provided for the elevator car can therefore be optimized.

In an alternative arrangement, the counterweight space of the elevator system is installed in the new stairwell. The counterweight space can be arranged on a side of the new stairwell nearer the elevator car. The counterweight space can therefore be constructed during installation of the new stairwell. Essentially, a passage through the zones of the former outer wall of the building is provided only in the uppermost region of the stairwell, through which passage a suspension means, which connects the counterweight to the elevator car, can be guided. A drive of the elevator system or deflection rollers can also be arranged in this uppermost region if necessary. Inspection openings can be arranged in the new stairwell, which openings make it possible to service the counterweight. This alternative makes it possible to pre-assemble the counterweight when the new stairwell is attached to the building. This can decrease the assembly time in the building itself.

DESCRIPTION OF THE DRAWINGS

Embodiments of the invention are explained in more detail in the following description with reference to the accompanying drawings, in which corresponding elements are denoted by the same reference signs. In the drawings.

DETAILED DESCRIPTION

Figure 1A:
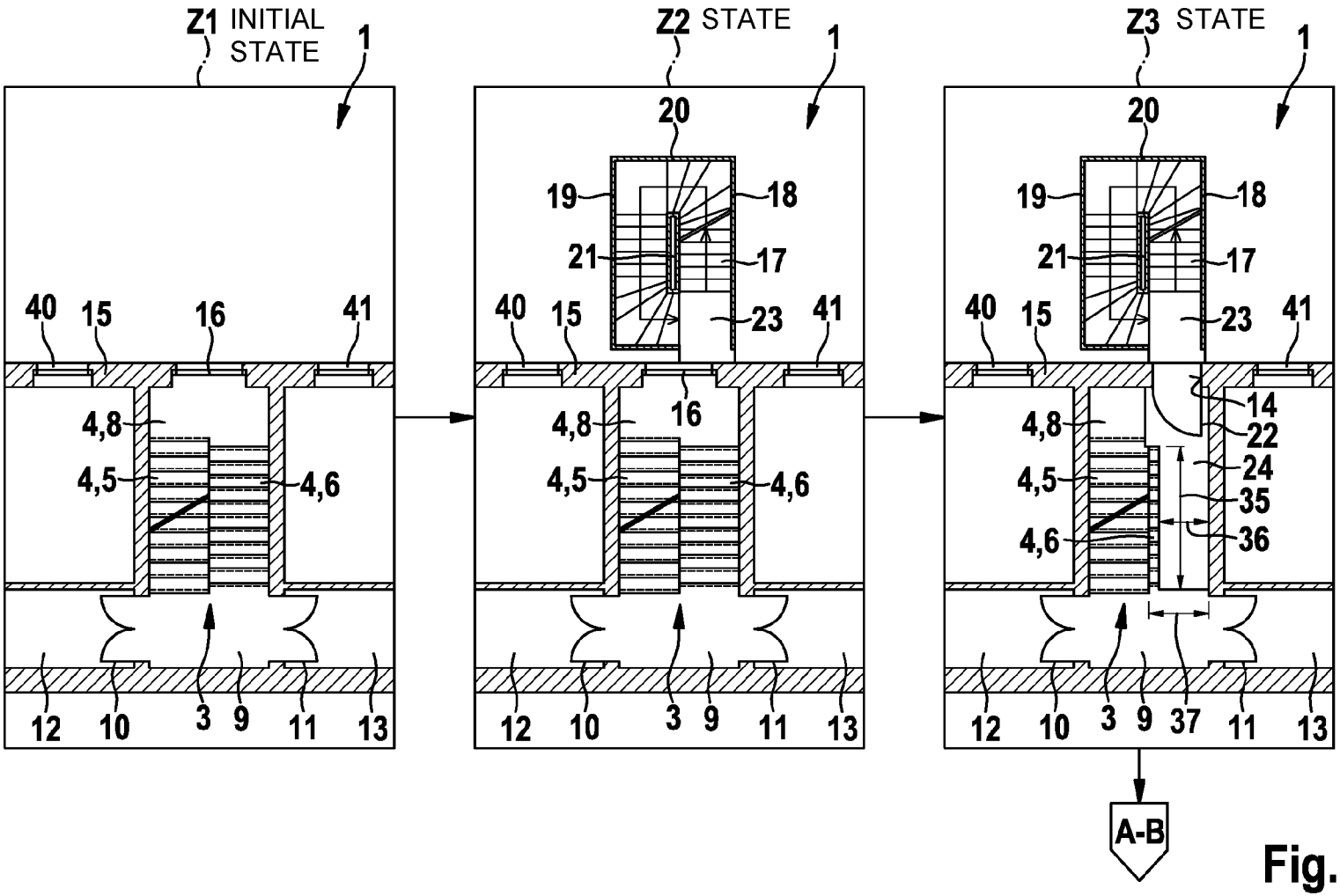
FIGS. 1A and 1B are flow diagrams for explaining an embodiment of the invention.
Figure 1B:
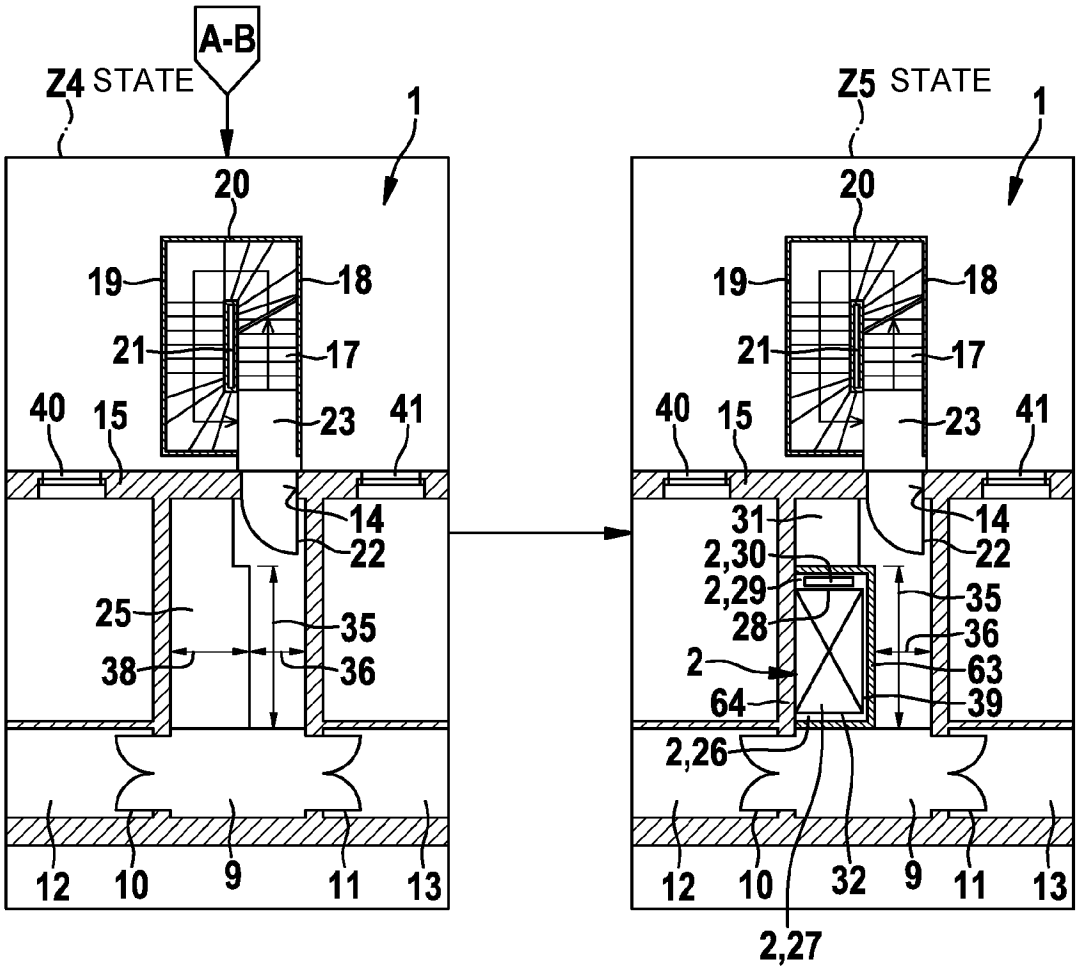

FIGS. 1A and 1B are flow diagrams for explaining an embodiment of the invention. The flow diagram is shown in two parts here, there being a connection at the connector A-B. The flow diagram begins with a state Z1, in which a building 1 is in an initial state. The building 1 comprises a former stairwell 3 having a former staircase 4. The former stairwell 3 and the former staircase 4 are referred to as "former" in this case in order to ensure that referencing is consistent throughout. In the context of planned conversion work to the building 1, the former staircase 4 is removed at least in substantial parts, so that it no longer functions as a staircase.

Figure 2A:
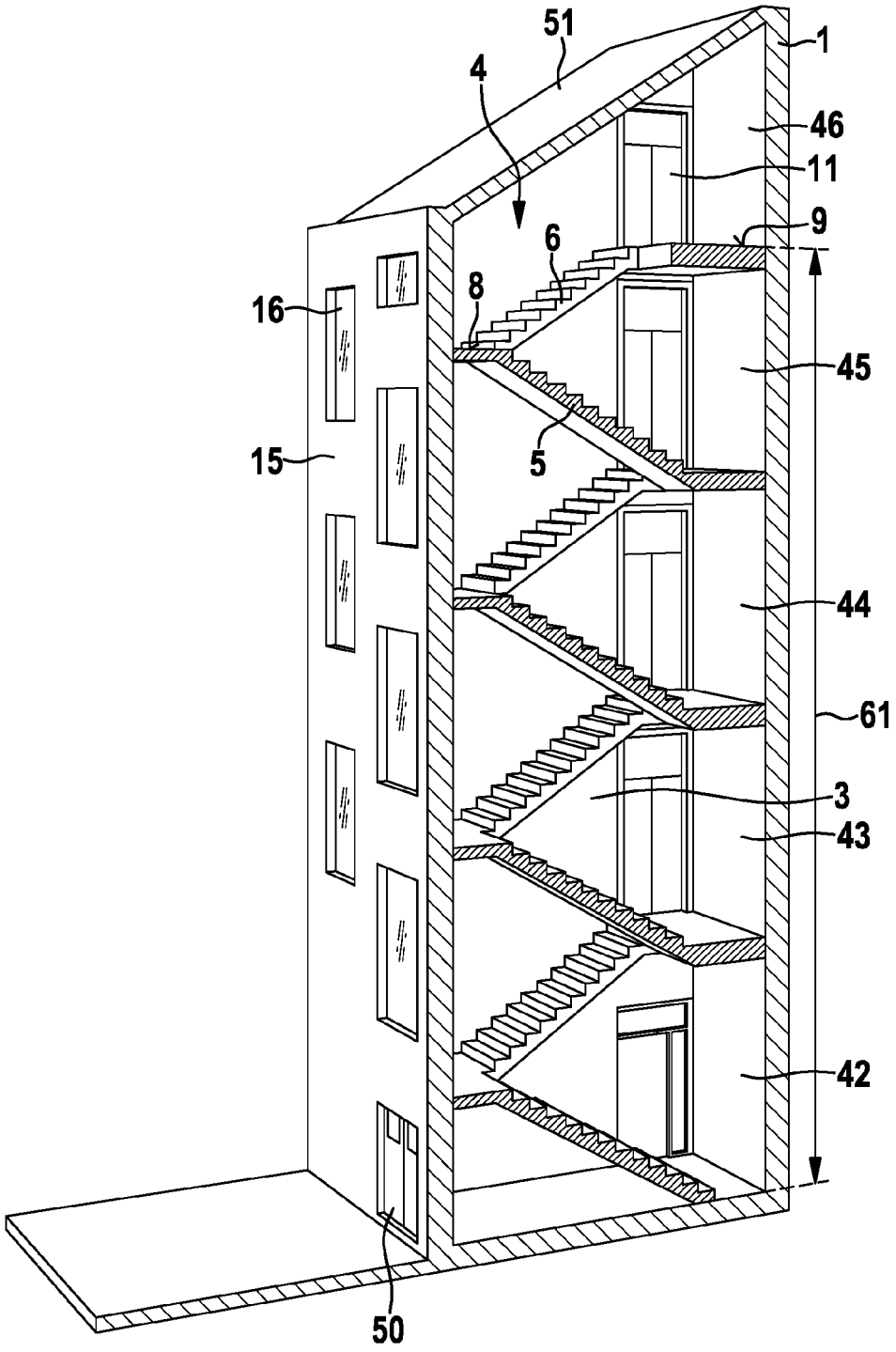
FIG. 2A to 2F are partial, schematic, three-dimensional views of a building in different states according to a possible conversion with the construction of an elevator system corresponding to a possible embodiment of the invention.
Figure 2B:
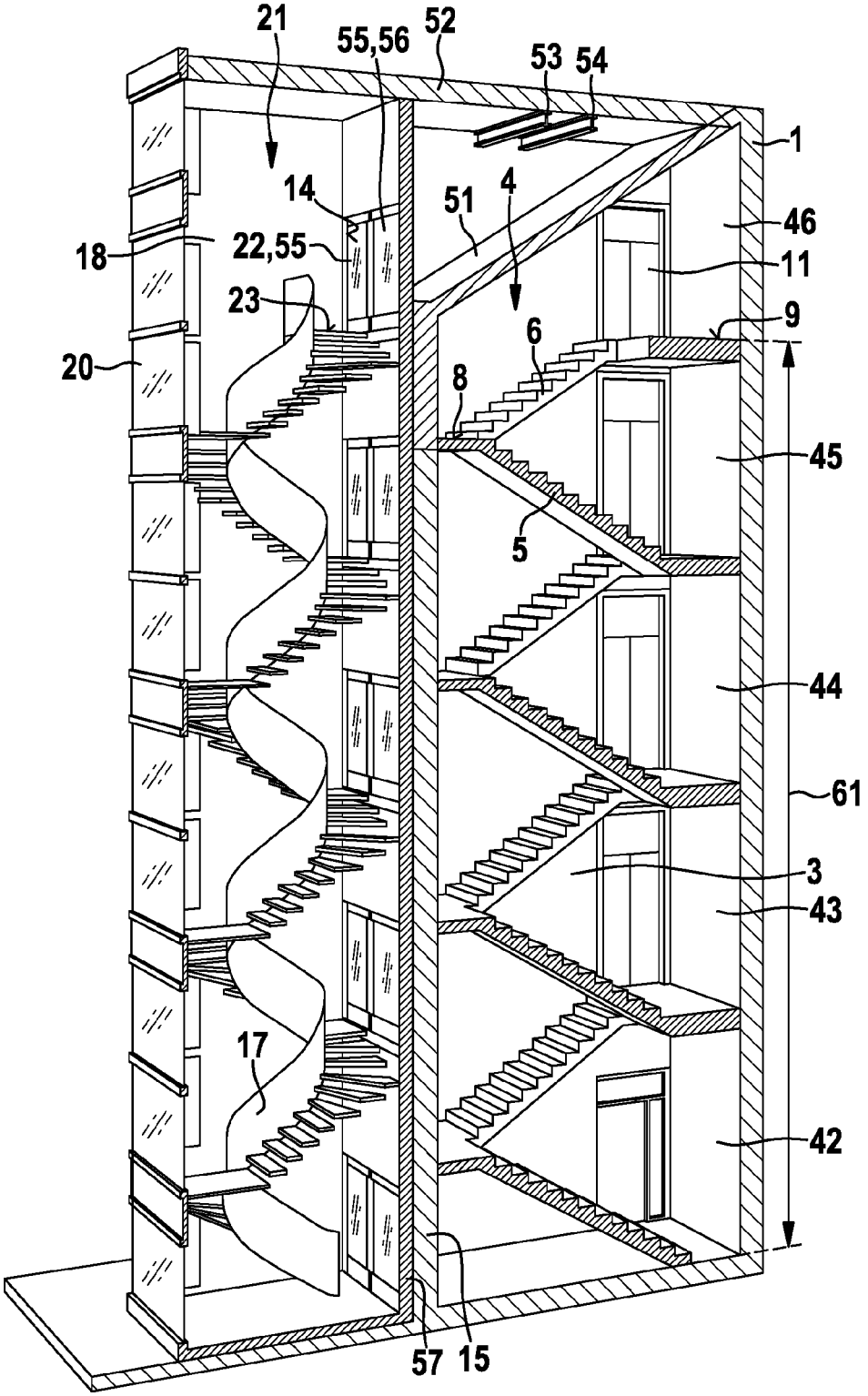
Figure 2C:
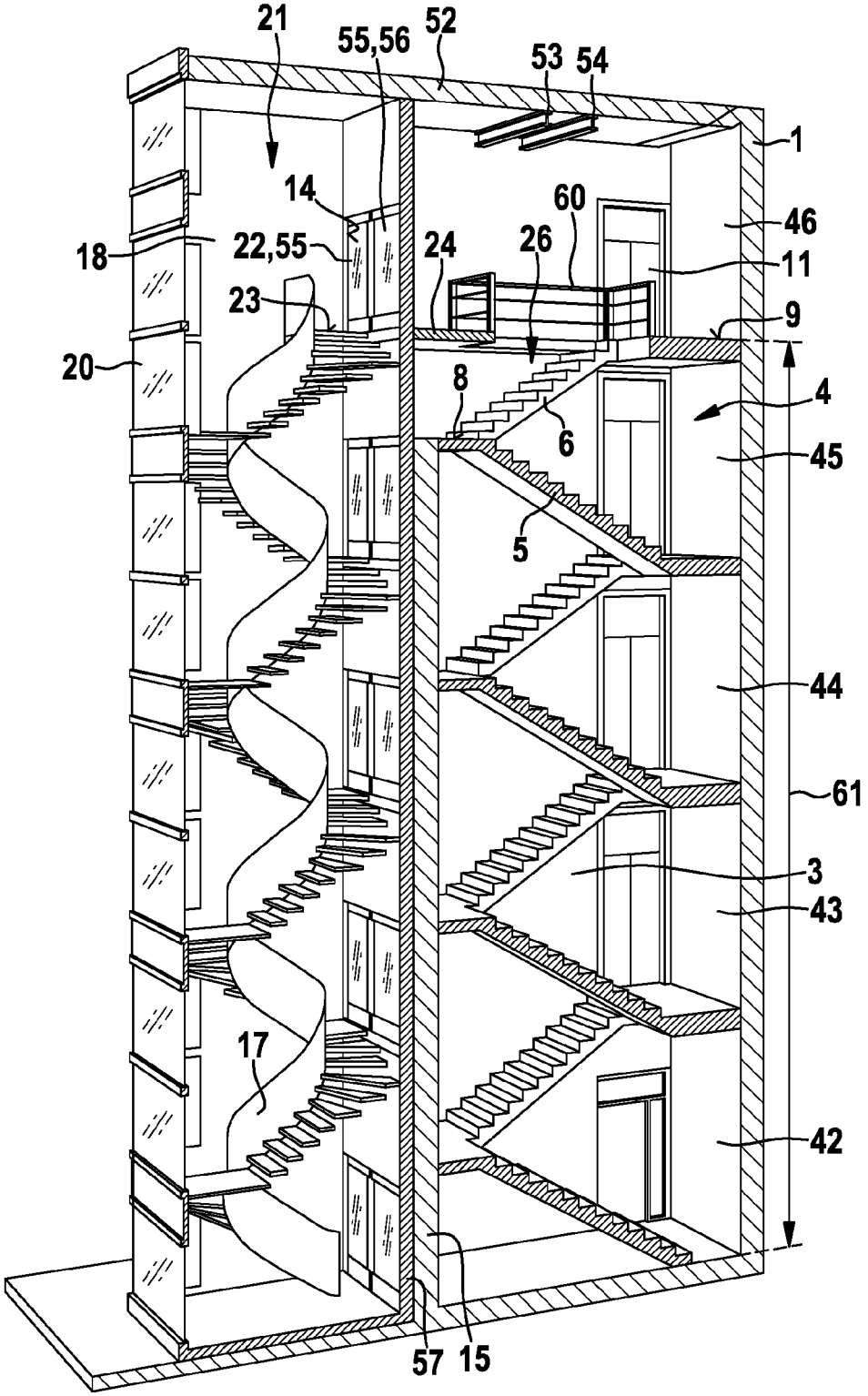
Figure 2D:
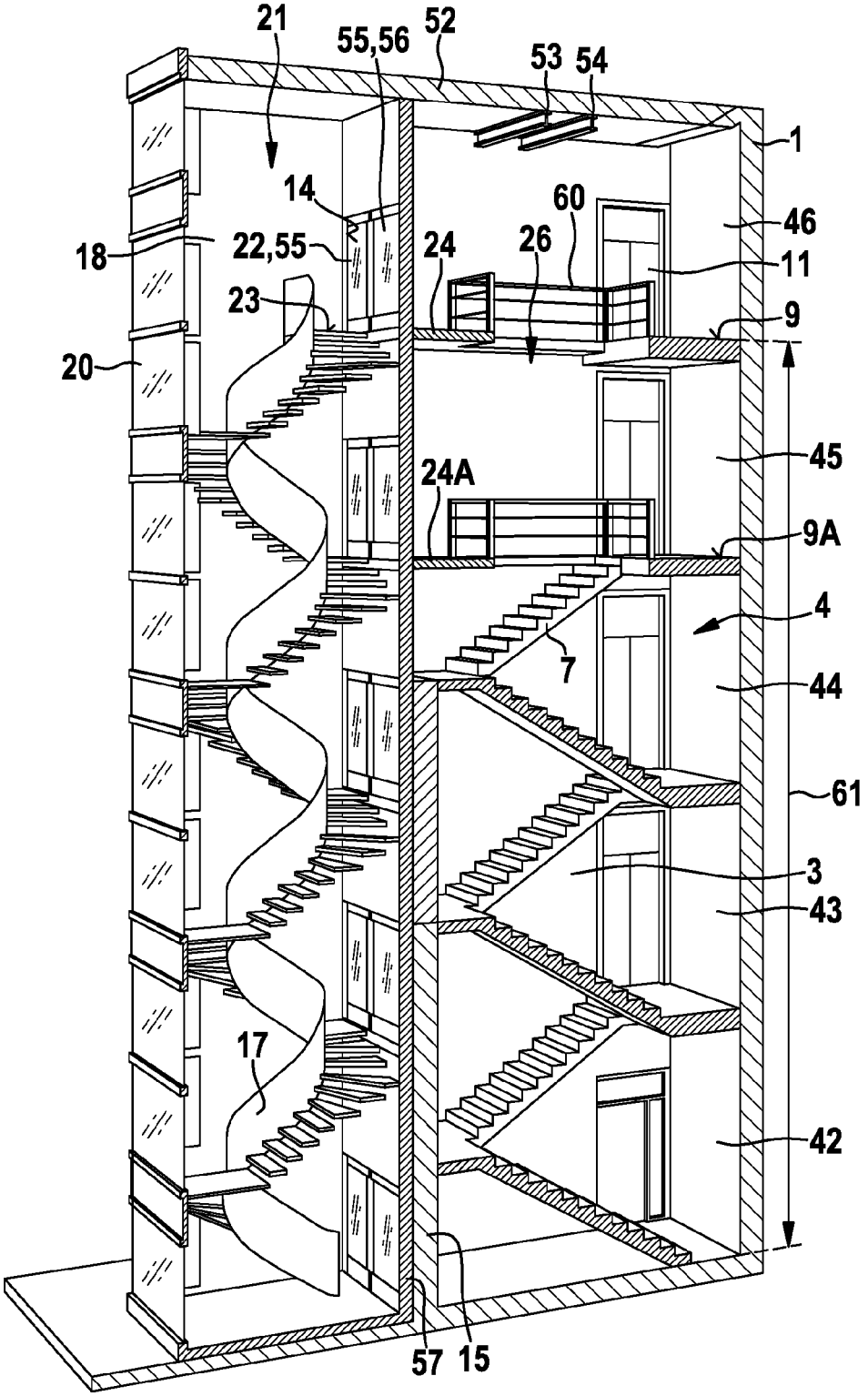

The former staircase 4 comprises flights of stairs 5, 6, 7 (FIG. 2D). The view of the state Z1 shows the flights of stairs 5, 6. The flights of stairs 5, 6 are interconnected via an intermediate landing 8 of the former staircase. Furthermore, a floor landing 9 is provided which is observed as independent of the former staircase 4 here. This means that the floor landing 9 is at least substantially maintained in the context of the conversion works, even if the floor landing 9 has the function of a stair landing of the former staircase 4.

Rooms 12, 13 inside the building 1 are accessible from the floor landing 9 via doors 10, 11. For access to the rooms 12, 13, access to the floor landing 9 is essential.

The building 1 comprises a wall 15, which is an outer wall 15 in this embodiment. In this embodiment, a window 16 is inserted into the outer wall 15, so that daylight can enter the former stairwell 3.

In the state Z2, a new staircase 17 is constructed outside the former stairwell 3. In this case, the new staircase 17 is separated from the former stairwell 3 by the wall 15. In this case, the new staircase 17 can be protected from weather influences by side walls 18, 19, 20, of which the side walls 18, 19 connect to the wall 15. The side walls 18 to 20 enclose a new stairwell 21 for the new staircase 17. It is optionally also possible, however, that one or more of the side walls 18 to 20 are attached only at a later point in time. In particular, the side wall 20 may initially remain open in order to bring necessary building materials or components to the individual floors via the new staircase 17.

In the state Z3, the wall 15 has been converted such that the window 16 is dispensed with and is correspondingly closed in part and that a door 22 is integrated into the wall 15 at a passage 14 introduced into the wall 15, via which door access is facilitated into the former stairwell 3 from the new staircase 17. Furthermore, a horizontal access bridge 24 is arranged between the new staircase 17 and the floor landing 9. When the door 22 is open, substantially flush access from the new staircase 17 to the floor landing 9 via the new staircase 17, the passage 14 and the access bridge 24 is possible. The two flights of stairs 5, 6 can be demolished at substantially the same time. The access bridge 24 is connected at one end to the substantially existing floor landing 9 and the other end can be connected to a staircase landing 23 of the new staircase 17 or it can alternatively be supported on existing side walls of the former stairwell 3, for example.

The measure described with reference to state Z3 is correspondingly repeated for each floor, until the former staircase 4 is completely demolished. This can lead to an open space 25 in the state Z4, for example, which open space can be used inter alia for the insertion of an elevator system 2.

In the state Z5, the open space 25 is used in part by the elevator system 2, an elevator car 27 of the elevator system 2 being arranged in an elevator shaft 26 of the elevator system 2. Furthermore, a counterweight space 29 is provided on the side 28 nearer the new staircase 17, in which counterweight space a counterweight 30 of the elevator system 2 is arranged. Furthermore, the access bridge 24 is extended to a landing 31.

In a modified embodiment, the counterweight space 29 may also be arranged on the side 32 of the elevator car 27 further away from the new stairwell 21.

As shown in the state Z5, the access bridge 24 comprises an access portion 35 passing the elevator shaft 26. The access portion 35 is designed having a minimum permissible access width 36 in this case. Additionally or alternatively, the access portion 35 may also have an access width 36 which is smaller than a width 37 of a former flight of stairs 6 of the former staircase 4, as shown in state Z3. As a result, in particular a width 38 of the elevator shaft 26 is optimally large.

This ensures stepless and preferably barrier-free access to the spaces 12, 13 from the elevator car 27 via the access bridge 24 and the floor landing 9.

In the embodiment shown in FIGS. 1A and 1B, an elevator car door may be provided on the side 32 nearer the floor landing 9, or on a side 39 nearer the access bridge 24. When there is sufficient space, it may be advantageous to arrange the elevator car door on the side 32, as this is nearer the doors 10, 11 to the rooms 12, 13. However, arranging on the side 39 usually has the advantage that a larger door opening is possible due to a correspondingly large elevator car door. In a specific arrangement, the door leaves of an elevator car door can also be arranged over a corner of the elevator car 27, which corner preferably relates to the sides 32, 39, thereby allowing very wide access to the elevator car 27.

In a modified embodiment, in which the counterweight 30 is arranged for example on the side 32 of the elevator car 27, it is possible to exit via the side 28 to the platform 31. This facilitates access to the elevator car 27 on the ground floor.

The structure and arrangement of the new stairwell 21 can take fire safety requirements into consideration by maintaining appropriate distances to adjacent windows 40, 41 of the building 1. In addition, modernizing elements, such as a riser for extinguishing water, communication lines and the like, can also be arranged in the new stairwell 21 and/or in the former stairwell 3.

Auxiliary means related to fire safety can be integrated in the new stairwell 21 and the access bridge 24. The access bridge 24 can therefore be equipped with sprinkler systems or with sprinkler heads 33 (FIG. 2E), which are supplied by lines for extinguishing water integrated in the new stairwell 21. At the same time, the access bridges 24 may also be provided with water drain channels 34 (FIG. 2F) which divert extinguishing water outward into the new stairwell 21 if necessary. In principle, the access bridge 24 can therefore be designed as a protective zone.

A space-saving design of the elevator system 2 with simultaneously large car dimensions of the elevator car 27 and of the elevator shaft 26 can be achieved. Simultaneously, further safety requirements for the building, such as requirements with regard to fire safety, can be easily met.

FIG. 2A to 2F are partial, schematic, three-dimensional views of the building 1 in different states according to a possible conversion with the construction of an elevator system 2 corresponding to a possible embodiment of the invention. It should be noted here that modifications are shown with regard to the embodiment shown in FIGS. 1A and 1B.

The conversion generally relates to specific floors 42 to 46, which are usually specified by planning the conversion project. Correspondingly, a region 61 of the former stairwell 3 extending over the specific floors 42 to 46 is produced, in which region the former staircase 4 is removed from the former stairwell 3, according to planning. In this case, all the floors 42 to 46 shown are specified, for example, and the region 61 relates to the entire former staircase 4.

FIG. 2A shows the building 1 as an existing building 1. In this case, an entrance door 50 is provided via which the former stairwell 3 is accessible. In the context of conversion, the entrance door 50 can be converted without barriers or a barrier-free entrance door 50 of this kind can be implemented at another location. In this embodiment, the former stairwell 3 is closed at the top by a roof slope 51.

FIG. 2B shows a first conversion measure. In this case, a new stairwell 21 is produced in front of the outer wall 15 of the building 1. The new stairwell 21 is protected from weather influences by side walls 18, 19, 20 and a new roof element 52. Due to the open view, the side wall 19 is not shown; however, said side wall is implemented opposite the side 18 in accordance with the view shown in FIGS. 1A and 1B. Glass elements can advantageously be integrated in the side walls 18 to 20, in order to allow daylight to enter the new stairwell 21. Furthermore, a design consisting of a correspondingly fire-resistant material may be possible in some cases, in order to provide fire protection. The roof element 52 functions simultaneously as an upper end of the former stairwell 3 after the building 1 has been converted. In this case, components 53, 54, in particular fastening elements 53, 54, which are used to construct the elevator system 2 can be fastened to the roof element 52, which may be provided as a prefabricated part.

The new staircase 17 is constructed in the new stairwell 21. Furthermore, conversion is carried out on the wall 15, windows 16 being replaced with a door 22 and a window 56 by combination elements 55 in this embodiment. In this embodiment, this is achieved in that an additional wall 57 is constructed in front of the previous outer wall 15. The outer wall 15 can then be completely or partially demolished in the region of the former stairwell 3. However, other conversion measures are also conceivable.

In the context of conversion, the roof slope 51 is also removed at least in part.

FIG. 2C shows a state of the building 1 during conversion, the roof pitch 51 already being demolished and the access bridge 24 being inserted into the former stairwell 3. A handrail 60 is also installed on the access bridge 24, so that passengers cannot fall into the existing elevator shaft 26. In this state, access is possible to all the floors 42 to 46 of the building 1. This access is possible specifically either via the former staircase 4 or via the new staircase 17 and the access bridge 24 with regard to the level on the floor landing 9. This means that only the level of the building 1 on the floor landing 9 is subject to temporary access restrictions due to the conversion work.

Subsequently, the flights of stairs 5, 6 and the intermediate landing 8 of the former staircase 4 are demolished.

FIG. 2D shows the building 1, a further access bridge 24A already being inserted with regard to a lower floor. Access to a floor landing 9A is possible from the new staircase 17 via the access bridge 24A.

Correspondingly, the further flights of stairs, in particular the flight of stairs 7, of the former staircase 4 are then demolished from the top to the bottom in a stepwise manner and access bridges 24B, 24C relevant thereto are introduced into the former stairwell 3.

Figure 2E:
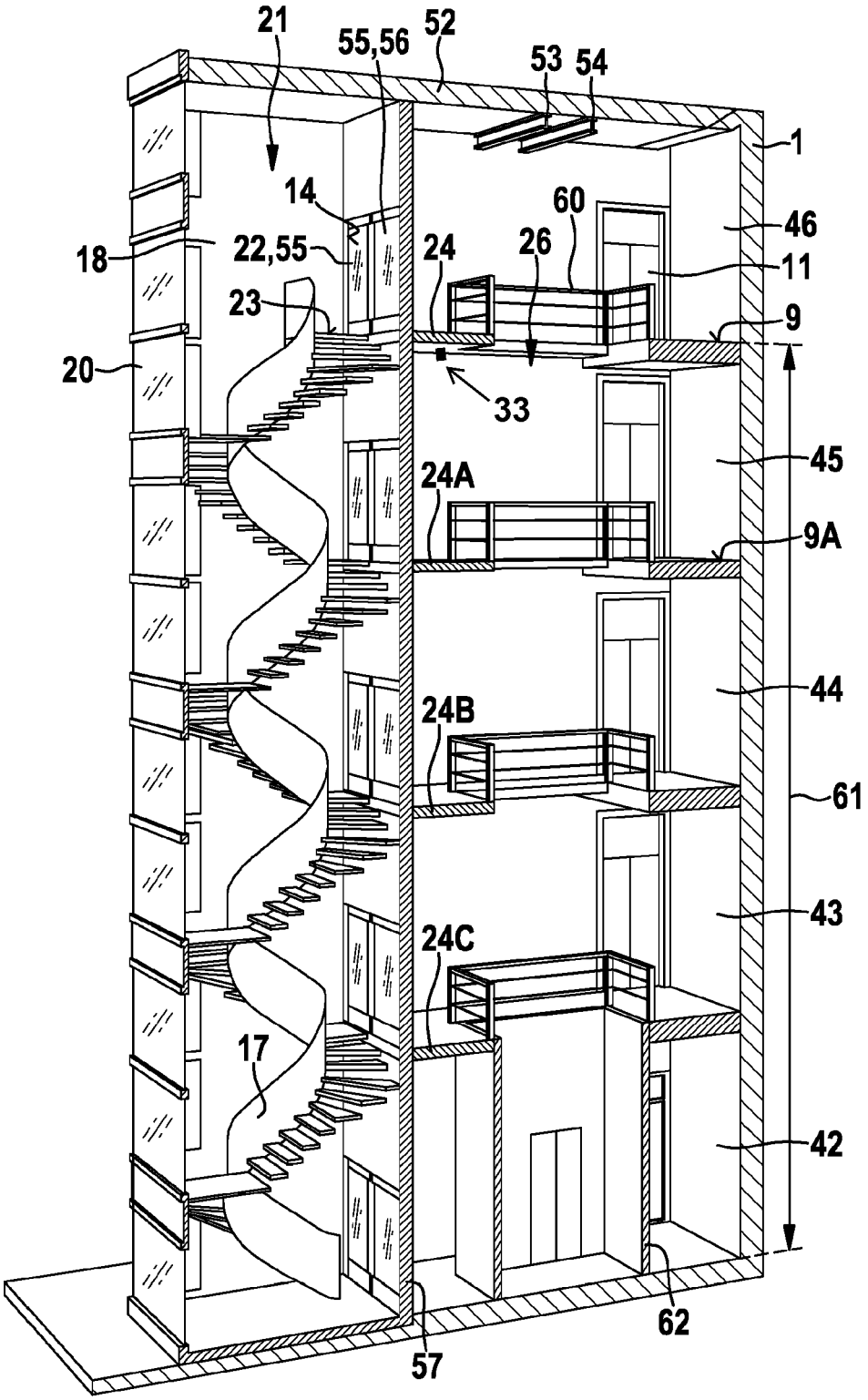

FIG. 2E shows the building 1 after the former staircase 4 has been demolished floor by floor. The region 61 over which the former staircase 4 is demolished extends over the entire former staircase 4. However, the region 61 can extend only over part of the former staircase 4. For example, the former staircase 4 can also lead to a basement, the portion of the former staircase 4 relevant thereto being maintained. The basement is a floor which is not affected and therefore does not belong to the specific floors, i.e. the floors 42 to 46 here.

Furthermore, wall elements 62 can be arranged in the former stairwell 3 preferably from bottom to top and in particular can be connected to the access bridges 24, 24A to 24C.

Figure 2F:
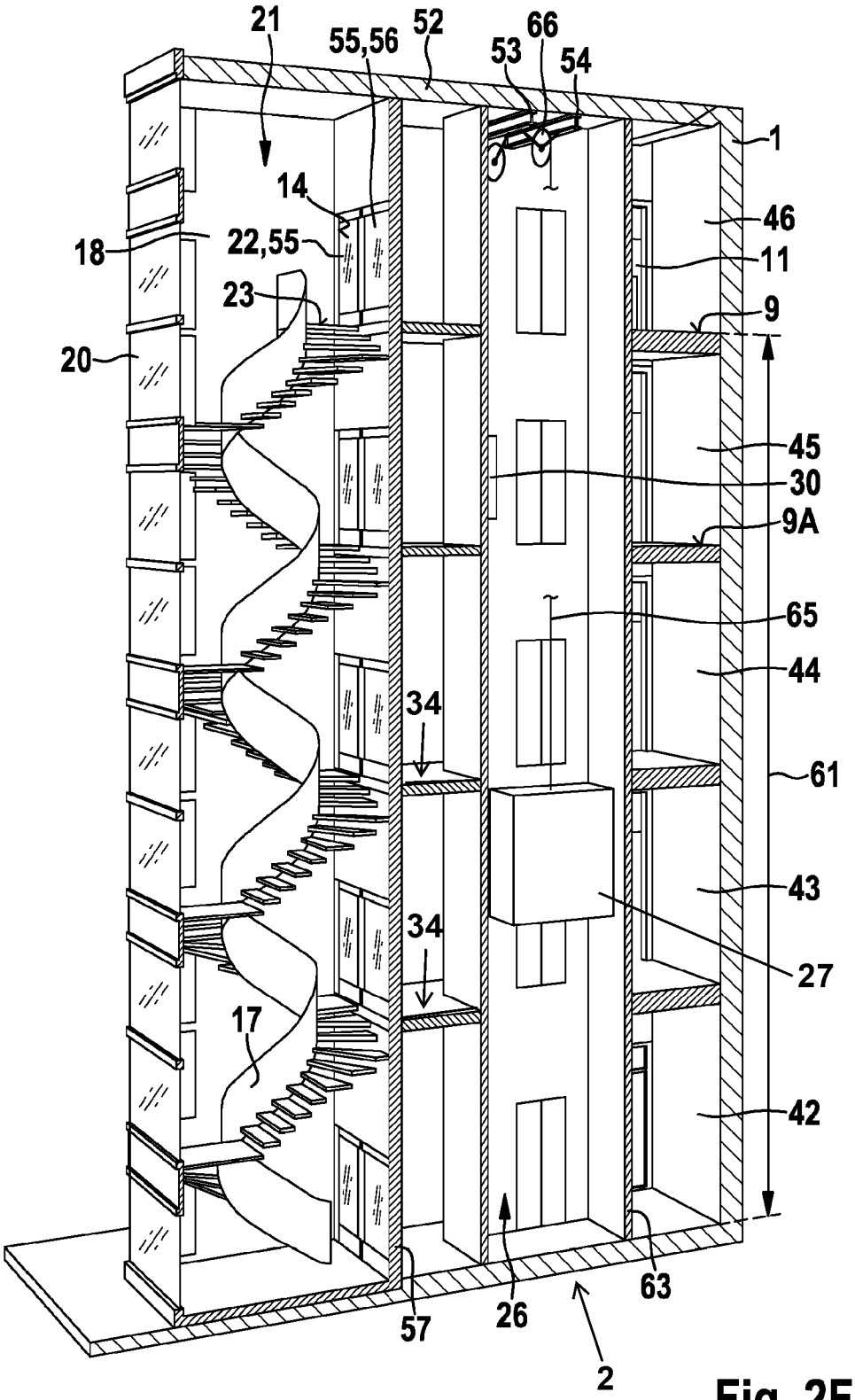

FIG. 2F shows the converted building 1 having the schematically shown constructed elevator system 2. In this case, the wall elements 62 form a wall 63. The elevator car 27 and the counterweight 30 are therefore suspended from at least one suspension means 65 inside the elevator shaft 26, which is enclosed by the wall 63 and a building wall 64 (see FIG. 1B). A schematically shown drive machine unit 66 having a drive sheave can be fastened to the components 53, 54, around which drive sheave the at least one suspension means 65 is guided.

Furthermore, guide rails for the counterweight 30 and the elevator car 27 can be arranged in the elevator shaft 26.

Components, in particular correspondingly dimensioned parts of the wall elements 62, door attachments or fastening structures for fastening guide rails, can already be attached to the access bridges 24, 24A to 24C when the access bridges 24, 24A to 24C are arranged in the former stairwell 3. The handrail 60 can therefore be designed as part of the wall element 62 of the elevator shaft 26, for example, or a door threshold of a shaft door can be attached to the access bridge.

The invention is not limited to the embodiment, possible design and modifications described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for modernizing a building including converting a former stairwell of the building to enable an elevator shaft of an elevator system to be constructed in the former stairwell, the elevator shaft providing stepless access to specific floors of the building from an elevator car of the elevator system in the elevator shaft, and constructing a new staircase outside the former stairwell, the method comprising the steps of:

removing the former staircase from the former stairwell at least in a region of the former stairwell extending over the specific floors; and disposing access bridges next to the elevator shaft constructed in the former stairwell, thereby enabling access from the new staircase to the specific floors.

2. The method according to claim 1 including constructing the new staircase in a new stairwell that is separated from the former stairwell by a wall of the building, the wall being an outer wall of the building or a former outer wall of the building, and forming passages in the wall that are adapted to be closed by doors and facilitate access through the passages from the new staircase to the specific floors via access bridges.

3. The method according to claim 1 wherein the access bridges each have at least a minimally permissible access width, at least along an access portion passing the elevator shaft, between the new staircase and a floor landing of an associated one of the specific floors.

4. The method according to claim 1 wherein the access bridges have an access width, at least along an access portion passing the elevator shaft, between the new staircase and a floor landing of an associated one of the specific floors, that is smaller than a width of a flight stairs of the former staircase.

5. The method according to claim 1 including constructing the new staircase before the former staircase is removed from the former stairwell at least over a region of the former stairwell extending over the specific floors and the access bridges are disposed in the former stairwell.

6. The method according to claim 5 including arranging the access bridges successively in the former stairwell from an uppermost floor of the specific floors to a lowermost floor of the specific floors.

7. The method according to claim 6 including arranging the access bridge for one of the specific floors in the former stairwell and then removing a portion of the former staircase between the one specific floor and a next one of the specific floors underneath the one specific floor.

8. The method according to claim 1 including constructing a wall for the elevator shaft in the former stairwell, and removing the former staircase from the former stairwell at least in the region of the former stairwell extending over the specific floors and disposing the access bridges in the former stairwell before the wall for the elevator shaft is constructed in the former stairwell.

9. The method according to claim 8 including constructing the wall for the elevator shaft from a lowermost floor of the specific floors to an uppermost floor of the specific floors with a plurality of wall elements.

10. The method according to claim 1 including attaching components for the elevator shaft to the access bridges before disposing the access bridges in the former stairwell.

11. The method according to claim 1 including providing a handrail fastened to each of the access bridges at the latest after disposition of the access bridges in the former stairwell and at least until a wall for the elevator shaft is constructed.

12. The method according to claim 1 including constructing the new staircase to enable bringing the access bridges to the specific floors via the new staircase to construct the elevator system, or constructing the access bridges to be longitudinally adjustable.

13. The method according to claim 1 including providing a counterweight space in the elevator shaft on a side of the elevator car nearer the new staircase, or in the elevator shaft on a side of the elevator car further away from the new staircase, or in the new stairwell on a side of the new stairwell nearer the elevator car.

14. The method according to claim 1 including attaching at least one sprinkler head to each of the access bridges, which sprinkler head is adapted to be supplied by a line for extinguishing water integrated in the new stairwell, and providing each of the access bridges with at least one water drain channel that is adapted to drain extinguishing water outward into the new stairwell.

15. A structure having an elevator system constructed in a building, comprising:

an elevator shaft of the elevator system being arranged in a converted former stairwell of the building and the elevator system being arranged to provide stepless access to specific floors of the building from an elevator car in the elevator shaft;

a new staircase constructed outside the former stairwell; and a plurality of access bridges disposed next to the elevator shaft in the former stairwell that provide flush access from the new staircase to the specific floors via the access bridges.

* * * * *